US007216506B2

(12) United States Patent
Shin et al.

(10) Patent No.: US 7,216,506 B2
(45) Date of Patent: May 15, 2007

(54) REFRIGERATOR

(75) Inventors: Youn-tae Shin, Kwangju (KR); Eun-mog Yang, Kwangju (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 411 days.

(21) Appl. No.: 10/820,715

(22) Filed: Apr. 9, 2004

(65) Prior Publication Data

US 2004/0221611 A1 Nov. 11, 2004

(30) Foreign Application Priority Data

May 9, 2003 (KR) ..... 10-2003-0029428

(51) Int. Cl.
*F25B 39/04* (2006.01)

(52) U.S. Cl. ..... 62/508; 62/448; 62/449

(58) Field of Classification Search ..... 62/508, 62/448, 449, 450, 452
See application file for complete search history.

(56) References Cited

U.S. PATENT DOCUMENTS

| | | | | |
|---|---|---|---|---|
| 1,841,616 | A | 1/1932 | Lipman | |
| 1,887,948 | A | 11/1932 | Scherer | |
| 3,736,768 | A * | 6/1973 | Harbour et al. | 62/455 |

FOREIGN PATENT DOCUMENTS

| | | |
|---|---|---|
| CN | 2480784 | 3/2002 |
| DE | 835152 | 3/1952 |
| DE | 29620350 | 3/1998 |
| EP | 0568809 | 3/1993 |
| GB | 500364 | 2/1939 |
| JP | 03233278 | 10/1991 |
| JP | 07305940 | 11/1995 |
| JP | 08068587 | 3/1996 |
| JP | 2000-154963 | 6/2000 |
| JP | 2000-274915 | 10/2000 |
| JP | 2001-99558 | 4/2001 |
| JP | 2001-243150 | 9/2001 |
| JP | 2001-263911 | 9/2001 |
| KR | 1999-012383 | 4/1999 |
| KR | 2000-15917 | 8/2000 |
| KR | 2000-56266 | 9/2000 |
| KR | 2001-80791 | 8/2001 |
| KR | 2001-98285 | 11/2001 |
| KR | 2002-13327 | 2/2002 |
| KR | 2003-21809 | 3/2003 |
| KR | 10-389431 | 6/2003 |

OTHER PUBLICATIONS

Korean Office Action issued Mar. 21, 2005.
Chinese Office Action issued Dec. 9, 2005.
European Search Report dated Mar. 29, 2006 in European Application No. 04252149.2-2301.

* cited by examiner

*Primary Examiner*—Melvin Jones
(74) *Attorney, Agent, or Firm*—Staas & Halsey LLP

(57) ABSTRACT

A refrigerator having a main body with at least one storage compartment and a component compartment having a rear opening, the refrigerator including a cover to cover the opening of the component compartment, the cover provided with air inlets and air outlets which are spaced apart from each other; a compressor and a condenser provided in the component compartment respectively corresponding to the air inlets and the air outlets; and a fan provided between the condenser and the air outlets, to expel air within the component compartment through the air outlets.

11 Claims, 8 Drawing Sheets

REFRIGERATOR

CROSS-REFERENCE TO RELATED APPLICATIONS

This application claims the benefit of Korean Application No. 2003-29428, filed May 9, 2003, in the Korean Intellectual Property Office, the disclosure of which is incorporated herein by reference.

BACKGROUND OF THE INVENTION

1. Field of the Invention

The present invention relates to a refrigerator, and, more particularly, to a refrigerator which increases thermal efficiency by forming a smooth airflow in a component compartment.

2. Description of the Related Art

Conventionally, a refrigerator comprises a refrigerator compartment, a freezer compartment, and a cooling system to cool items stored in the freezer compartment and the refrigerator compartment.

The conventional cooling system comprises: a compressor to compress a refrigerant; a condenser to condense the gaseous refrigerant compressed by the compressor to a liquid refrigerant; and an evaporator to evaporate the refrigerant received from the condenser while absorbing surrounding latent heat, thereby generating a cooling air in the surroundings.

As shown in FIG. 1, the refrigerator is provided with a main body 8 having at least one storing compartment, and a component compartment 1 provided in a lower part of the main body 8, the component compartment 1 having an opening on a back side of the main body 8. A cover 5 is detachably provided in the opening of the component compartment 1.

The component compartment is provided with components for a cooling system, for example, a compressor 2 and a condenser 3. A fan 4 is provided adjacent to a sidewall of the component compartment, blowing toward the compressor 2 and the condenser 3, to cool the compressor 2 and the condenser 3.

The cover 5 is provided with air inlets 7 which are disposed at a portion of the cover 5 corresponding to an inlet of the fan 4, and which allow outside air to be let in by driving the fan 4, and air outlets 6 which are disposed opposite to the air inlets 7, and which allow air which absorbs heat released from the components of the component compartment 1 to be let out.

A cooling process of the component compartment with the above configuration is described as follows, with reference to FIG. 2. The fan 4, which dissipates heat generated from the compressor 2 and the condenser 3, operates as the refrigerator operates. That is, if the fan is rotated in one direction by driving a fan motor, an outside air is let in through the air inlets of the cover 5. The inlet air passes through the condenser 3 and the compressor 2 in turns, absorbs the heat generated therefrom, and is let out through the air outlets 6 of the cover 5.

The conventional dissipation structure described above does not efficiently use a space of the component compartment 1, since the fan 4, the condenser 3, and the compressor 2 are disposed in a line. Also, the conventional dissipation structure does not smoothly let air in and out, since the air inlet 7 and the air outlets 6 are disposed parallel to a blowing direction of the fan 4. Thus, a portion of the air which absorbs the heat of the component compartment 1 remains in the component compartment 1, thereby lowering the efficiency of the refrigerator.

SUMMARY OF THE INVENTION

It is an aspect of the present invention to provide a refrigerator which increases space efficiency by compactly configuring components in a component compartment, and which increases thermal efficiency by forming a smooth airflow.

Additional aspects and/or advantages of the invention will be set forth in part in the description which follows, and, in part, will be obvious from the description, or may be learned by practice of the invention.

To achieve the above and/or other aspects according to the present invention, there is provided a refrigerator having a main body with at least one storage compartment and a component compartment having a rear opening, the refrigerator comprising a cover to cover the opening of the component compartment, the cover provided with air inlets and air outlets which are spaced apart from each other; a compressor and a condenser provided in the component compartment respectively corresponding to the air inlets and the air outlets; and a fan provided between the condenser and the air outlets, to expel air within the component compartment through the air outlets.

According to an aspect of the invention, the refrigerator may further comprise a plurality of air guiding parts provided at the air outlets. The air guiding parts may be sloped upward.

According to an aspect of the invention, the fan may comprise an impeller to move the air, a fan motor to drive the impeller, and a casing provided between the impeller and the fan motor, wherein the casing hermetically contacts a surrounding area of the air outlets of the cover.

According to an aspect of the invention, the casing may comprise a fan accommodating part to accommodate the impeller, and having air through holes to allow air surrounding the condenser to be absorbed, an engaging bracket to couple the casing to the cover of the component compartment and the fan motor, and a sealing part provided at an end of the accommodating part to form a sealed space by hermetically contacting the surrounding of the air outlets.

BRIEF DESCRIPTION OF THE DRAWINGS

These and/or other aspects and advantages of the invention will become apparent and more readily appreciated from the following description of the embodiments, taken in conjunction with the accompany drawings of which.

DETAILED DESCRIPTION OF THE PREFERRED EMBODIMENTS

Figure 1:
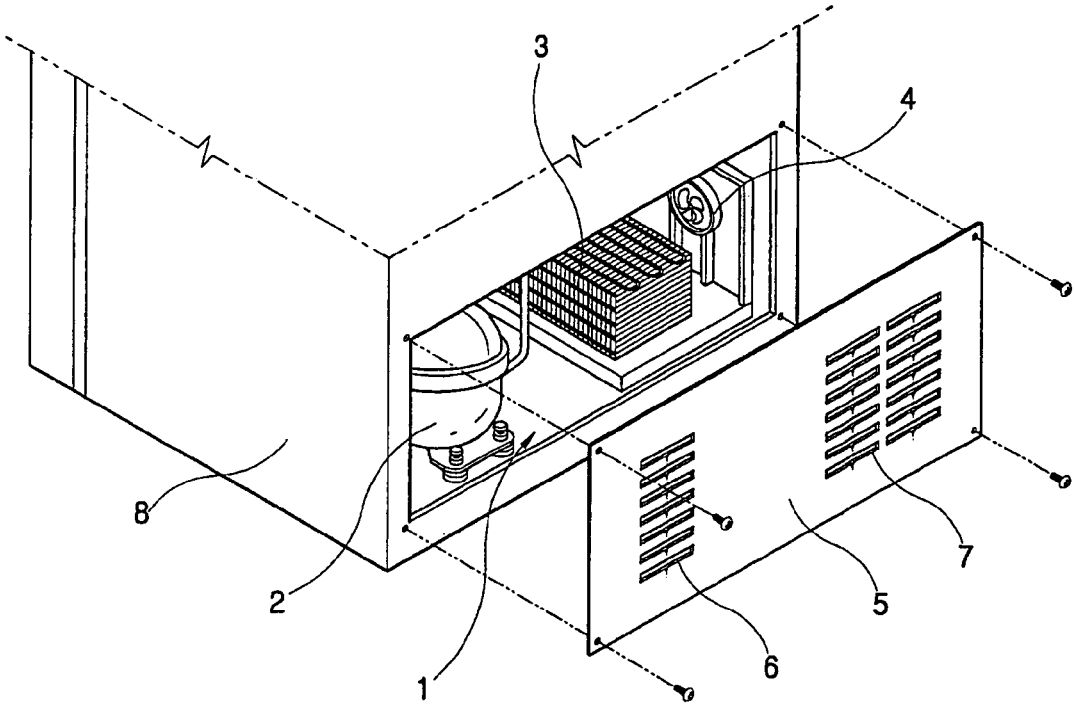
FIG. 1 (PRIOR ART)
FIG. 1 is a perspective view of a component compartment of a conventional refrigerator.
Figure 2:
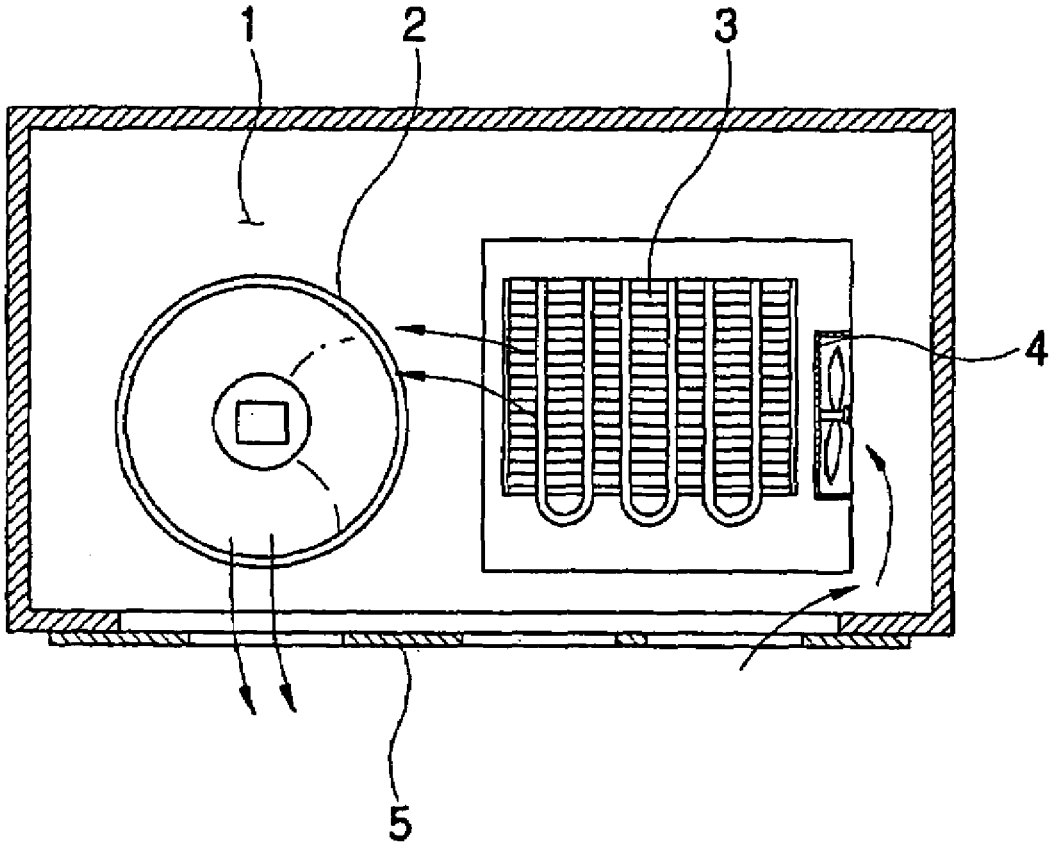
FIG. 2 (PRIOR ART)
FIG. 2 is a plan view illustrating an interior of the component compartment of the conventional refrigerator in FIG. 1.

Reference will now be made in detail to the embodiments of the present invention, examples of which are illustrated in the accompanying drawings, wherein like reference numerals refer to the like elements throughout. The embodiments are described below to explain the present invention by referring to the figures.

The present invention may, however, be embodied in many different forms and should not be construed as being limited to the embodiments set forth herein; rather, these embodiments are provided so that the present disclosure will convey the concept of the invention to those skilled in the art.

Figure 3:
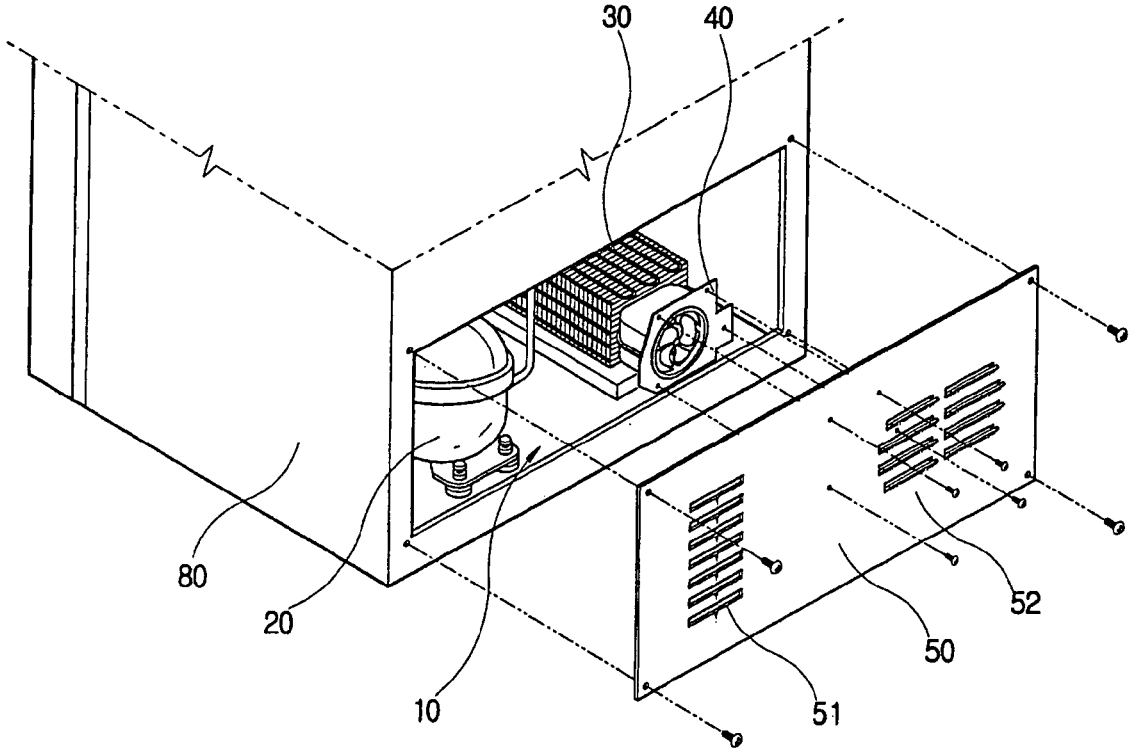
FIG. 3 is a perspective view of a component compartment of a refrigerator according to an embodiment of the present invention.

As shown in FIG. 3, a refrigerator according to an embodiment of the present invention comprises a main body 80 having at least one storage compartment (not shown), a component compartment 10 provided with components for driving a cooling system of the refrigerator in a lower part of the main body 80, and having a rear opening, and a cover 50 which covers the opening of the component compartment 10, and is formed with air inlets 51 and air outlets 52 to guide air to flow in and out.

The component compartment 10 is provided with a compressor 20 to compress a refrigerant, a condenser 30 to condense the gaseous refrigerant compressed by the compressor 20 to a liquid refrigerant, and a fan 40 to cool the compressor 20 and the condenser 30.

The compressor 20 is provided in one side of the component compartment 10 corresponding to the air inlets 51 of the cover 50. The condenser 30 is provided in a side of the compressor 20 corresponding to the air outlets 52 of the cover 50.

Figure 4:
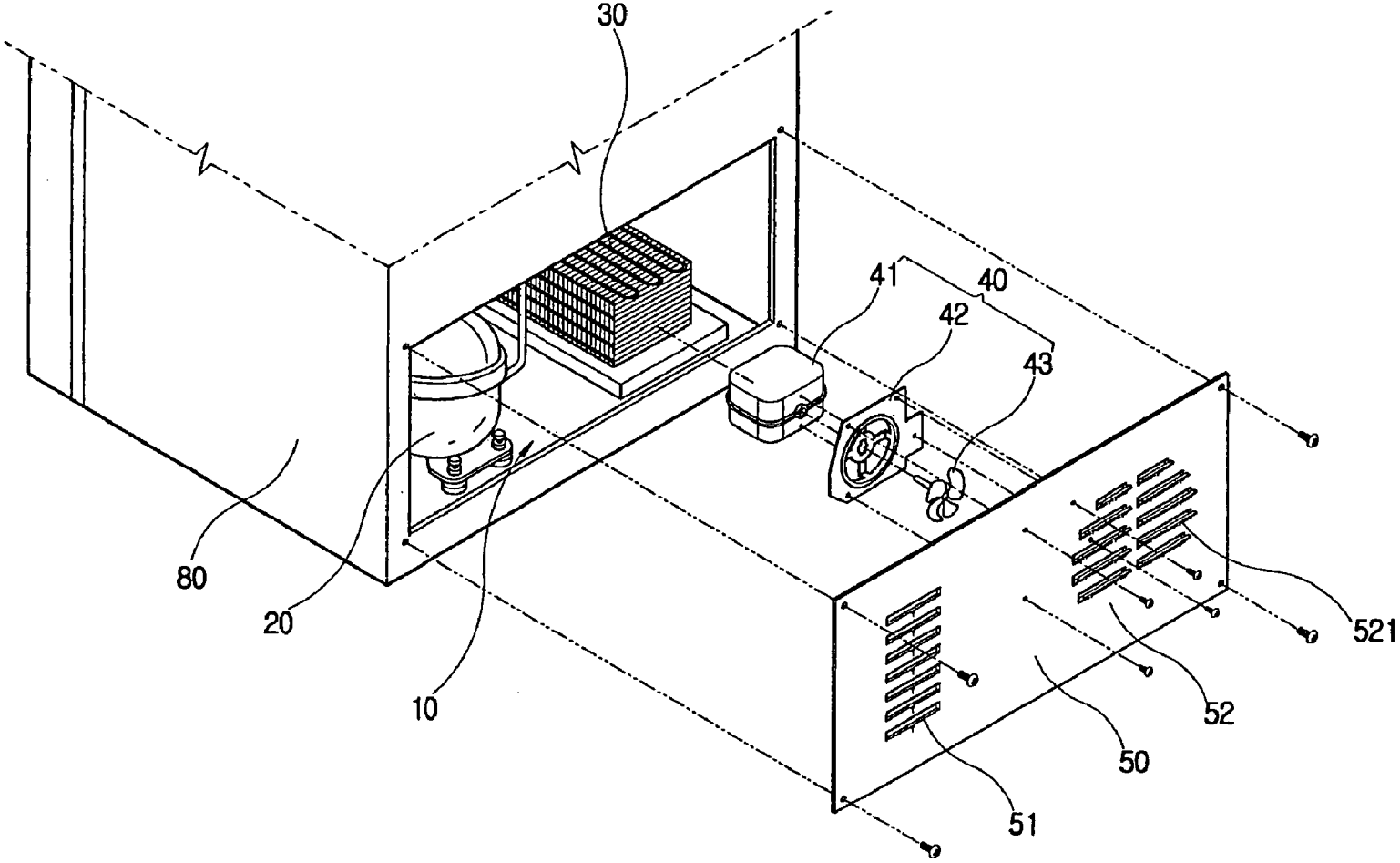
FIG. 4 is a partially exploded perspective view of the component compartment in FIG. 3.

As shown in FIG. 4, the fan 40 is provided between the condenser 30 and the air outlets 52 of the cover 50, toward a rear of the refrigerator. The fan 40 comprises an impeller 43, a fan motor 41 to drive the impeller 43, and a casing 42 provided between the impeller 43 and the fan motor 41. The casing 42 forms a sealed space by contacting the cover 50 of the component compartment 10, and supports the impeller 43 and the fan motor 41.

Figure 5:
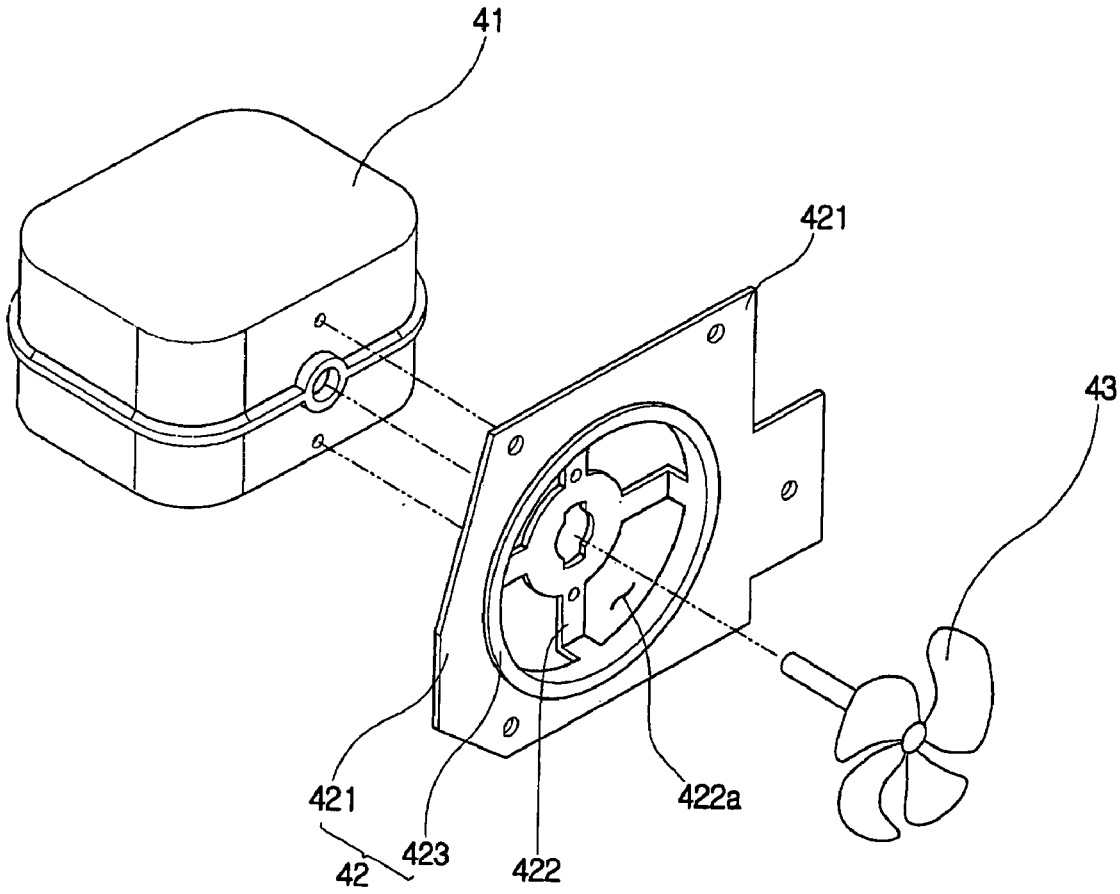
FIG. 5 is a partially exploded perspective view of a fan of the component compartment of FIG. 3.

As shown in FIGS. 4 and 5, the casing 42 comprises an engaging bracket 421 mounting the fan 40 in the component compartment 10 by being coupled to the cover 50 and the fan motor 41, a fan accommodating part 422 in which the impeller 43 is accommodated and rotates, a sealing part 423 forming a sealed space by hermetically contacting with a surrounding area of the air outlets 52. The fan accommodating part 422 is provided with air through holes **422*a* allowing air of the component compartment 10 to be absorbed and expelled through the air outlets 52 by the impeller 43**.

As shown in FIG. 4, the cover 50 is formed with the air inlets 51 and the air outlets 52. The air inlets 51 guide outside air into the component compartment 10, and the air outlets 52 guide air which absorbs heat of the component compartment 10 outward. Also, the air outlets 52 are formed with air guiding parts 521 which are sloped in an upward direction relative to the exterior of the refrigerator, so that the air within the component compartment 10 is let out upward.

With the above configuration, airflow and operation of the component compartment 10 of the refrigerator are described as follows.

Figure 6:
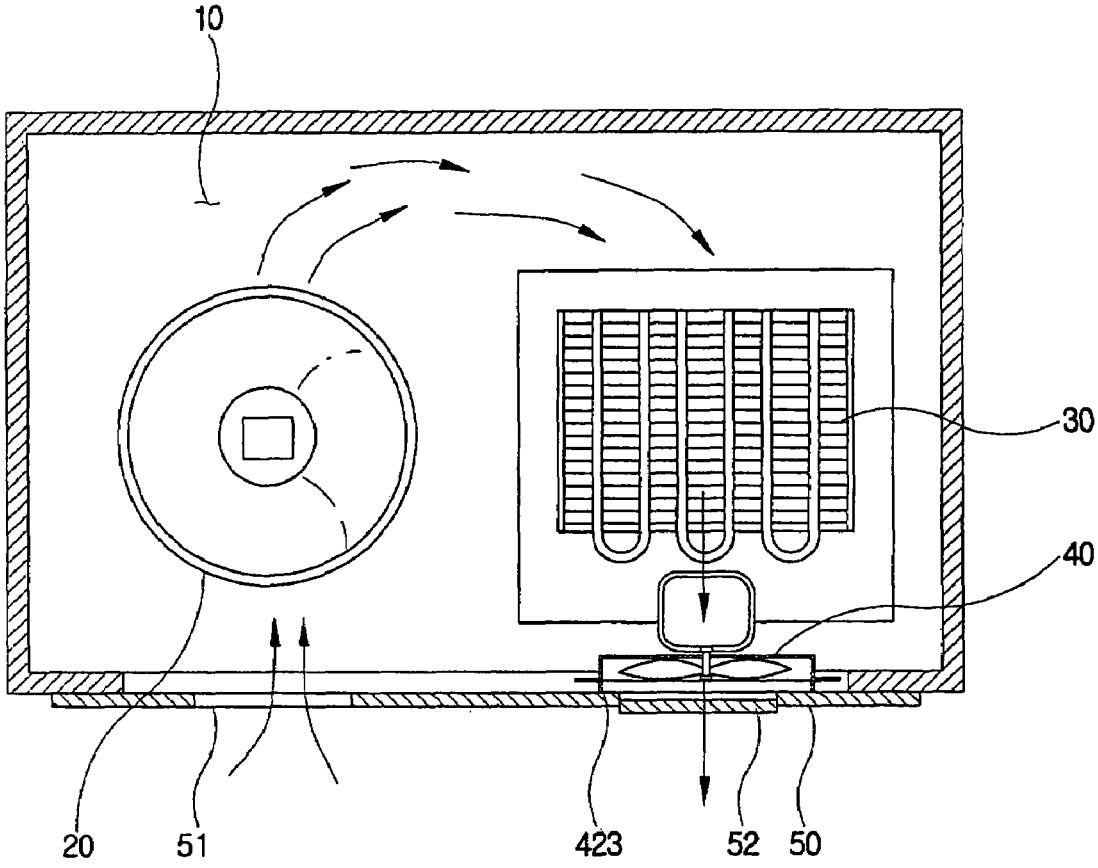
FIG. 6 is a plan view illustrating an interior of the component compartment of FIG. 3.
Figure 7:
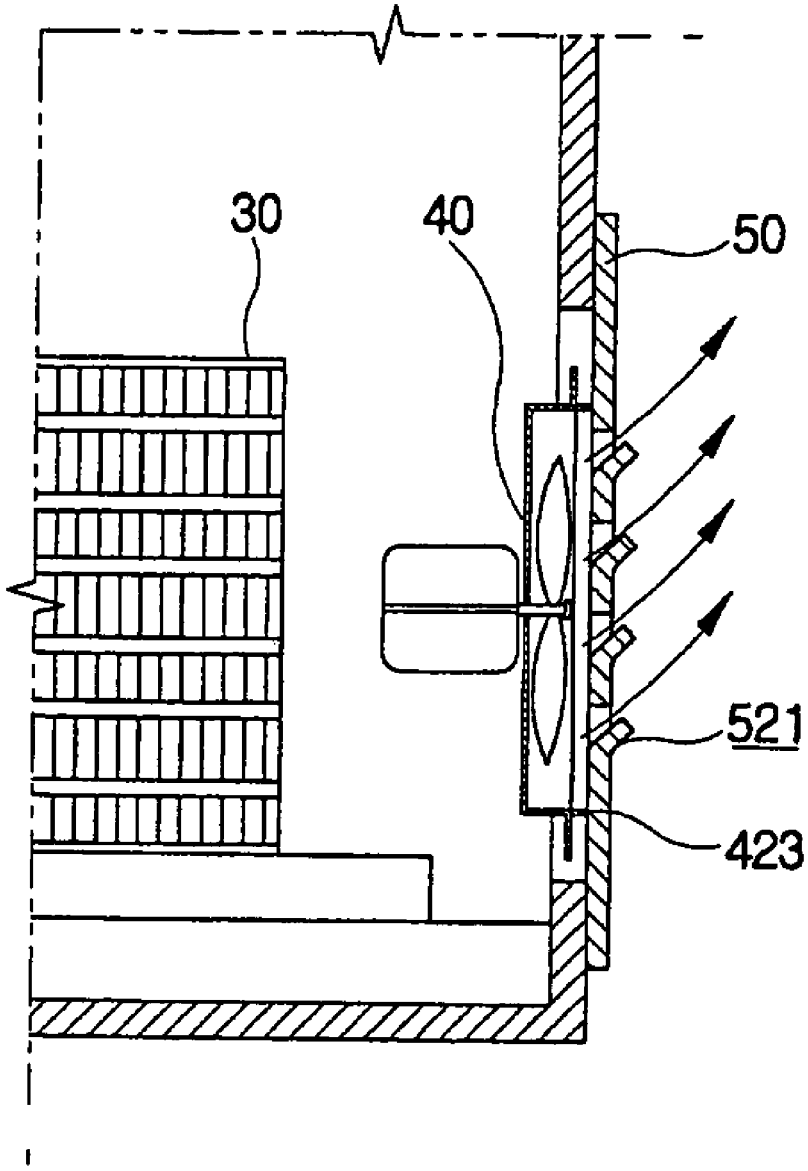
FIG. 7 is a side sectional view of the component compartment of FIG. 3.

As shown in FIGS. 6 and 7, when the cooling system operates, the compressor 20, the condenser 30, and the fan 40 operate. Since the fan 40 is provided in the rear area of the refrigerator between the condenser 30 and the air outlets 52, surrounding air of the lower part of the refrigerator is let in through the air outlets 52 of the cover 50 as pressure of the component compartment 10 is lowered.

The inlet air absorbs heat generated from the compressor 20, and heat generated during a heat exchanging process of the condenser 30, and is then blown out of the refrigerator by the fan 40. If the air expelled from the component compartment 10 remains in an area surrounding the lower part of the refrigerator, and is let in the component compartment 10 of the refrigerator again, the cooling efficiency of the component compartment 10 may be lowered. Thus, the air outlets 52 of the cover 50 are provided with the air guiding parts 521 which are sloped upward. Therefore, the air expelled through the air outlets 52 of the cover 50 is blown in an upward direction relative to the refrigerator.

Moreover, a blowing efficiency of the fan 40 is increased, since the fan 40 and the cover 50 form a sealed space by the casing 42 of the fan 40.

Figure 8:
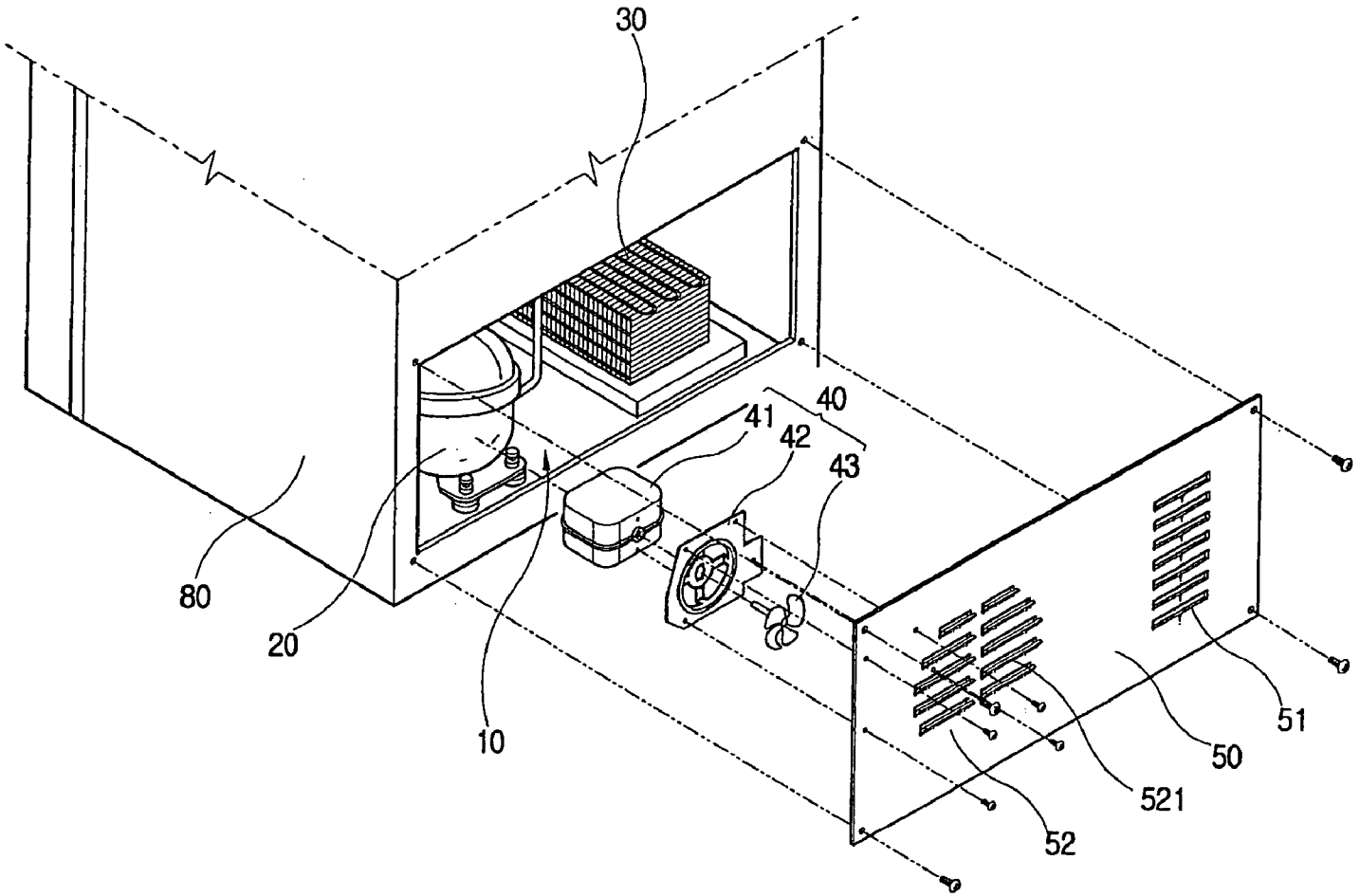
FIG. 8 is a partially exploded perspective view of the component compartment of the refrigerator according to another embodiment of the present invention.

FIG. 8 is a partially exploded perspective view of the component compartment of the refrigerator according to another embodiment of the present invention. As shown in FIG. 8, the fan 40 is provided between the compressor 20 and the air outlets 52 of the cover 50, rather than between the condenser 30 and the air outlets 52 of FIG. 4. In the embodiment shown in FIG. 8, the inlet air is drawn in on the condenser 30 side of the cover 50, absorbs heat generated during a heat exchanging process of the condenser 30 and from the compressor 20, and is then blown out by the fan 40 through the air outlets 52 on the compressor 20 side of the cover 50.

The configuration of the refrigerator according to the present invention may be applied to a built-in type refrigerator, in which kitchen furniture forms the built-in type refrigerator as one body by accommodating a refrigerator.

In the case of the built-in type refrigerator, the air flow as described above may be formed if air inlets are provided in a lower part of the kitchen furniture, and air outlets are provided in an upper part of the kitchen furniture. This allows surrounding air of the lower part of the refrigerator to be let in the component compartment 10 through the air inlets 51, and air which absorbs heat of the component compartment 10 is let out upward of the refrigerator.

As described above, according to the present invention, since a fan is provided between a condenser and air outlets toward a rear of a refrigerator, a component compartment is compactly configured and smooth airflow is formed, to thereby increase thermal efficiency of the refrigerator.

Alternatively, the fan may be provided between a compressor and a plurality of air inlets of a component compartment cover, the fan hermetically contacting a surrounding area of the air inlets so as to draw in air from outside the component compartment. The air which absorbs heat from components in the component compartment is then forced out of air outlets by the resulting increase in air pressure in the component compartment.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A refrigerator having a main body with at least one storage compartment and a component compartment having a rear opening, the refrigerator comprising:

a cover to cover the opening of the component compartment, the cover provided with air inlets and air outlets which are spaced apart from each other;

a compressor and a condenser provided in the component compartment respectively corresponding to the air inlets and the air outlets; and a fan provided in the component compartment between the condenser and the air outlets, to expel air within the component compartment through the air outlets, supported by a casing between the fan and a fan motor to drive the fan such that when the casing attaches to the cover a seal is formed between the casing and the cover to encapsulate the fan so that all of the air moving through the fan is expelled through the air outlets.

2. The refrigerator according to claim 1, further comprising a plurality of air guiding parts provided at the air outlets.

3. The refrigerator according to claim 2, wherein the air guiding parts are sloped upward.

4. A refrigerator having a main body with at least one storage compartment and a component compartment having a rear opening, the refrigerator comprising:

a cover to cover the opening of the component compartment, the cover provided with air inlets and air outlets which are spaced apart from each other;

a compressor and a condenser provided in the component compartment respectively corresponding to the air inlets and the air outlets; and a fan provided between the condenser and the air outlets, to excel air within the component compartment through the air outlets, wherein the fan comprises:

an impeller to move the air;

a fan motor to drive the impeller; and a casing provided between the impeller and the fan motor;

wherein the casing hermetically contacts a surrounding area of the air outlets of the cover so that all of the air moving through the fan is expelled through the air outlets, and wherein the casing comprises:

a fan accommodating part to accommodate the impeller, and having air through holes to allow air surrounding the condenser to be absorbed;

an engaging bracket to couple the casing to the cover of the component compartment and the fan motor; and a sealing part provided at an end of the accommodating part to form a sealed space by hermetically contacting the surrounding area of the air outlets, so that all of the air moving through the fan is expelled through the air outlets.

5. A refrigerator having a main body with at least one storage compartment and a component compartment having a rear opening, the refrigerator comprising:

a cover to cover the opening of the component compartment, the cover provided with air inlets and air outlets which are spaced apart from each other;

a compressor and a condenser Provided in the component compartment respectively corresponding to the air inlets and the air outlets;

a fan provided between the condenser and the air outlets, to excel air within the component compartment through the air outlets; and a plurality of air guiding carts provided at the air outlets, wherein the fan comprises:

an impeller to move the air;

a fan motor to drive the impeller; and a casing provided between the impeller and the fan motor;

wherein the casing hermetically contacts a surrounding area of the air outlets of the cover so that all of the air moving through the fan is expelled through the air outlets, and wherein the casing comprises:

a fan accommodating part to accommodate the impeller, and having air through holes to allow air surrounding the condenser to be absorbed;

an engaging bracket to couple the casing to the cover of the component compartment and the fan motor; and a sealing part provided at an end of the accommodating part to form a sealed space by hermetically contacting the surrounding area of the air outlets, so that all of the air moving through the fan is expelled through the air outlets.

6. A refrigerator having a main body with at least one storage compartment and a component compartment, the refrigerator comprising:

a cover to cover an opening of the component compartment;

air inlets provided in the cover;

air outlets provided in the cover; and a fan in the component compartment to expel air from the component compartment; and a casing to support the fan, the casing being arranged between the fan and a fan motor to drive the fan such that when the casing attaches to the cover a seal is formed between the casing and the cover to encapsulate the fan so that all of the air moving through the fan is expelled through the air outlets.

7. The refrigerator according to claim 6, wherein the casing comprises:

a fan accommodating part to accommodate an impeller of the fan, and having air through holes to allow air surrounding the condenser to be absorbed;

an engaging bracket to couple the casing to the cover of the component compartment and the fan motor; and a sealing part provided at an end of the accommodation part to form a sealed space by hermetically contacting the surrounding area of the air outlets, so that all of the air moving through the fan is expelled through the air outlets.

8. The refrigerator according to claim 6, further comprising a plurality of air guiding parts provided at the air outlets.

9. The refrigerator according to claim 8, wherein the air guiding parts are sloped upward.

10. The refrigerator according to claim 8, wherein the air guiding parts guide the expelled air away from the air inlets.

11. A refrigerator having a main body with at least one storage compartment and a component compartment, the refrigerator comprising:

a cover to cover an opening of the component compartment;

air inlets provided in the cover;

air outlets provided in the cover; and a fan in the component compartment to draw air into the component compartment;

a casing to support the fan, the casing being arranged between the fan and a fan motor to drive the fan such that when the casing attaches to the cover a seal is formed between the casing and the cover to encapsulate the fan so that all of the air moving through the fan is drawn in through the air outlets.

* * * * *

UNITED STATES PATENT AND TRADEMARK OFFICE

CERTIFICATE OF CORRECTION

PATENT NO. : 7,216,506 B2
APPLICATION NO. : 10/820715
DATED : May 15, 2007
INVENTOR(S) : Youn-tae Shin et al.

It is certified that error appears in the above-identified patent and that said Letters Patent is hereby corrected as shown below:

Column 5, Line 40, change “excel” to --expel--.

Column 6, Line 1, change “Provided” to --provided--.

Column 6, Line 5, change “excel” to --expel--.

Column 6, Line 7, change “carts” to --parts--.

Signed and Sealed this

Fourteenth Day of August, 2007

JON W. DUDAS
*Director of the United States Patent and Trademark Office*